US005966688A

United States Patent [19]

Nandkumar et al.

[11] Patent Number: 5,966,688

[45] Date of Patent: Oct. 12, 1999

[54] SPEECH MODE BASED MULTI-STAGE VECTOR QUANTIZER

[75] Inventors: Srinivas Nandkumar, Silver Spring; Kumar Swaminathan, North Potomac, both of Md.

[73] Assignee: Hughes Electronics Corporation, El Segundo, Calif.

[21] Appl. No.: 08/958,143

[22] Filed: Oct. 28, 1997

[51] Int. Cl.[6] ..... G10L 3/02

[52] U.S. Cl. ..... 704/222; 704/219

[58] Field of Search ..... 704/211, 214, 704/205, 207, 208, 210, 222, 230

[56] References Cited

U.S. PATENT DOCUMENTS

| | | | |
|---|---|---|---|
| 5,495,555 | 2/1996 | Swaminathan | 395/2.16 |
| 5,596,676 | 1/1997 | Swaminathan et al. | 704/208 |
| 5,596,677 | 1/1997 | Jarvinen et al. | 704/220 |
| 5,651,026 | 7/1997 | Lin et al. | 375/240 |
| 5,732,389 | 3/1998 | Kroon et al. | 704/223 |
| 5,734,789 | 3/1998 | Swaminathan et al. | 704/206 |
| 5,751,903 | 5/1998 | Swaminathan et al. | 395/2.39 |
| 5,774,837 | 6/1998 | Yeldener et al. | 704/208 |

OTHER PUBLICATIONS

Mano et al, "Design of a Pitch Synchronous Innovation CELP Coder for Mobile Communications", IEEE Journal on Selected Areas in Communications, Jan. 1995.

Quiros et al, "Analysis and Quantization Procedures for a real–Time Implementation of a 4.8 kb/s CELP Coder", ICASSP 1990, Feb. 1990.

Chiu et al, "A dual–band excitation LSP codec for very low bit rate transmission", Speech Image Processing, and Neural Networks, 1994 Int'l Symposium, Jan. 1994.

*Primary Examiner*—David R. Hudspeth
*Assistant Examiner*—Michael N. Opsasnick
*Attorney, Agent, or Firm*—John T. Whelan; Michael W. Sales

[57] ABSTRACT

A speech mode based multi-stage vector quantizer is disclosed which quantizes and encodes line spectral frequency (LSF) vectors that were obtained by transforming the short-term predictor filter coefficients in a speech codec that utilizes linear predictive techniques. The quantizer includes a mode classifier that classifies each speech frame of a speech signal as being associated with one of a voiced, spectrally stationary (Mode A) speech frame, a voiced, spectrally non-stationary (Mode B) speech frame and an unvoiced (Mode C) speech frame. A converter converts each speech frame of the speech signal into an LSF vector and an LSF vector quantizer includes a 12-bit, two-stage, backward predictive vector encoder that encodes the Mode A speech frames and a 22 bit, four-stage backward predictive vector encoder that encodes the Mode 13 and the Mode C speech frames.

39 Claims, 5 Drawing Sheets

SPEECH MODE BASED MULTI-STAGE VECTOR QUANTIZER

BACKGROUND OF THE INVENTION

The present invention generally relates to digital voice communications systems and, more particularly, to a speech mode based multi-stage line spectral frequency vector quantizer that can be used in any speech codec that utilizes linear predictive analysis techniques for encoding short-term predictor parameters. The invention achieves high coding efficiency in terms of bit rate, performs effectively across different handsets and speakers, accommodates selective error protection for combating transmission errors and requires only moderate storage and computing power.

BACKGROUND ART

In speech codecs, the frequency shaping effects of the vocal tract are modeled by the short term predictor. The parameters of the short term predictor are obtained by a technique called linear predictive analysis which results in a set of coefficients of a stable all-pole filter. A typical model order for the short term predictor is ten having filter coefficients updated at intervals of every 10 to 30 ms. These filter coefficients are not suitable for quantization or transmission because small changes in these coefficients can result in large changes in the short term spectral envelope of the speech signal (which the short term predictor seeks to model) and which may make the filter unstable. For this reason, these filter coefficients are transformed into an alternative representation that is better suited for quantization and transmission. Examples of alternative representations are log area ratios, arc sine of reflection coefficients, line spectral frequencies, etc. The use of line spectral frequency (LSF) vectors has increasingly become popular in recent standard speech codecs because LSF vectors have attractive properties that make them easy to compute and quantize. Examples of standard speech codecs that utilize LSF vectors are the US Federal Standard 1016, the enhanced full-rate TDMA digital cellular standard IS-641, the enhanced variable rate CDMA digital cellular standard IS-127, etc.

The quantization of LSF vectors can be done by scalar or vector quantization techniques. If high coding efficiency is desired, then vector quantization techniques are necessary in order to maintain performance. The higher computational and storage requirements of these techniques have been made somewhat affordable by advances in VLSI technology. Nevertheless, vector quantization schemes need to be designed with the computational power and storage limitations (cost) in mind in order to be useful. Typically, the high coding efficiency is compromised in order to be within these cost limitations.

An example of a vector quantization scheme that achieves a compromise between cost and coding efficiency is the split vector quantization scheme. Here, the LSF vector having, for example, ten vector components, is split into, for example, three sets of groups, each having three or four vector components therein. For each of the split vector groups, the split vector quantization scheme identifies a vector (stored within a different codebook) that is the closest thereto. Because the codebooks for each of the split vectors only have three or four components therein, these codebooks have an exponentially fewer number of addresses covering a smaller vector space than a codebook having vectors covering the larger tenth-order vector space. This fact means that less memory needs to be used to produce the three split vector codebooks than the larger single codebook for the tenth-order space and that the addresses of the split-vector codebooks can be uniquely identified using a smaller number of bits.

U.S. Pat. No. 5,651,026 discloses a split vector quantization scheme that is used in conjunction with a speech mode detector to reduce the addressing size of the codebook associated with a transmitter/receiver system to 26 bits, with 24 bits used to encode the line spectral frequency vectors and two bits used to encode the optimum speech category as being one of IRS filtered voiced, IRS filtered unvoiced, non-IRS filtered voiced or non-IRS filtered unvoiced. The IRS filter is a linear phase finite-duration impulse response (FIR) filter that is used to model the high pass filtering effects of handset transducers and that has a magnitude response that conforms to the recommendations in the ITU-T P. 48. In this system a 3-4-3 split vector quantization is employed using 8-, 10- and 6-bit codebooks for the voiced speech mode categories while a 3-3-4 split vector quantization is employed using 7-, 8- and 9-bit codebooks for the unvoiced categories. In each case, two bits are used to encode the optimum category which results in a total of 26 encoding bits for a system that uses LSF vectors having ten line spectral frequencies. While this split vector quantization scheme reduces the number of encoding bits to approximately 26 for a typical speech frame, it is desirable to lower the number of encoding bits to an even lower value while retaining its performance.

One prior art standard, known as the IS-641 TDMA standard, uses a 26 bit split vector quantization scheme for encoding the LSF vector. The IS-641 device uses first-order backward prediction over adjacent LSF frames to obtain an LSF residual vector and then quantizes the LSF residual vector using a three-way split vector quantizer. The IS-127 CDMA standard uses an enhanced variable rate codec that has a 28 bit, four-way split vector quantizer that quantizes LSF vectors for the full-rate (8 Kbps) option and a 22 bit, three-way split vector quantizer that quantizes LSF vectors for the half-rate (4 Kbps) option. However, the 22 bit, three-way split vector quantizer introduces considerable spectral distortion into the decoded signal which is undesirable.

It has also been suggested to provide a multi-stage vector quantizer in which multiple codebooks, each storing a limited number of different sets of vectors, are used to produce a composite LSF residual vector. In this scheme, all of the components of a vector, such as an LSF vector, are compared with the vector components stored in a first codebook to identify the closest vector in the first codebook. The difference between this closest vector and the input LSF vector is an LSF residual vector which is then compared with the vectors stored in the second codebook to identify a second-stage closest vector. The difference between the residual vector and the second-stage closest vector is a further residual vector that is used in a third stage to produce a third-stage closest vector. The process of comparing residual vectors with vectors stored in a codebook continues through all of the stages, with the output vector being the sum of the identified vectors in each of the codebooks. Such a multi-stage vector quantization scheme is described in, for example, LeBlanc et al., "Efficient Search and Design Procedures for Robust Multi-Stage VQ of LPC Parameters for 4 kb/s Speech Coding," IEEE Transactions on Speech and Audioprocessing, Vol. 1, No. 4 (October 1993). While these vector quantization schemes allow the encoding bit rate to be reduced a small amount over other prior art encoding methods, it is desirable to reduce the encoding bit rate even further while still maintaining the robustness of quantization.

SUMMARY OF THE INVENTION

The present invention relates to a technique for performing efficient multi-stage vector quantization of LSF parameters in a speech processor at a lower aggregate bit rate than that available in prior art devices while still providing a coding scheme that is robust to bit errors and conducive to bit selective error encoding schemes. The inventive technique uses speech mode based, multi-stage quantization of LSF residual vectors obtained in a first-order backward prediction unit. In particular, a twelve bit, two-stage codebook is used to encode LSF vectors categorized as spectrally stationary (Mode A) speech vectors (or frames) and a 22 bit, four-stage codebook is used to encode LSF vectors categorized as voiced, spectrally non-stationary (Mode B) speech vectors and unvoiced (Mode C) speech vectors, which are also spectrally non-stationary.

According to one aspect of the present invention, a digital signal encoder for use in encoding a digital signal for transmission in a communication system includes a mode classifier that classifies the digital signal as being associated with one of a plurality of classes, a converter that converts the digital signal into a vector and a vector quantizer having a first section that quantizes the vector according to a first quantization scheme when the signal is classified as being associated with a first one of the classes and a second section that quantizes the vector according to a second quantization scheme when the signal is classified as being associated with a second one of the classes. Preferably, the digital signal is a speech signal and the mode classifier classifies the signal as being associated with one of a spectrally stationary class and a spectrally non-stationary class or, alternatively as being associated with one of a voiced spectrally stationary class, a voiced spectrally non-stationary class and an unvoiced class.

The converter may be a line spectral frequency (LSF) converter that converts the signal into an LSF vector and, preferably, each of the first and second vector quantizer sections comprises a multi-stage vector quantizer connected in a backward predictive configuration. In one embodiment, the first vector quantizer section includes two stages and the second vector quantizer section includes four stages, each of which includes a codebook that is addressable using a six-bit or less address.

According to another aspect of the present invention, a line spectral frequency (LSF) vector quantizer for use in encoding an LSF vector in a digital communication system includes a mode classifier that classifies the LSF vector as being associated with one of a plurality of modes, such as a spectrally stationary mode and a spectrally non-stationary mode, a first LSF vector quantizer section that quantizes the LSF vector when the LSF vector is associated with a first one of the plurality of modes and a second LSF vector quantizer section that quantizes the LSF vector when the LSF vector is associated with a second one of the plurality of modes.

According to a still further aspect of the present invention, a method of encoding a speech signal includes the steps of dividing the speech signal into a series of speech frames, converting each of the speech frames into a vector, such as an LSF vector, identifying a mode (such as a spectrally stationary or a spectrally non-stationary mode) associated with each of the speech frames, and encoding the vector for each of the speech frames based on the mode associated with that speech frame. Preferably, the step of encoding includes encoding spectrally stationary and spectrally non-stationary speech frames using different multi-stage, backward predictive LSF vector encoders.

DETAILED DESCRIPTION OF A PREFERRED EMBODIMENT

As will be noted, the present invention is an improvement on vector quantization of speech signals. While the present invention is described herein for use, and has particular application in digital cellular communication networks, this invention may be advantageously used in any product that requires compression of speech for communications.

In his classic work entitled "A Mathematical Theory of Communication," Bell System Technical Journal, Vol. 27 (1948), Shannon illustrated that the most economical method of coding information requires a bit rate no greater than the entropy of the source and that this rate could be achieved by coding large groups, or vectors, of samples rather than coding the individual samples. Such a coding technique may be accomplished using a codebook. According to this technique, to transmit a vector, one transmits the index (i.e., the address) if its entry in a codebook. Because the receiver has its own copy of the codebook, the receiver can use the received address to recover the transmitted vector. However, the vectors stored in the codebook are not a complete set of all the possible vectors but, instead, are a small, yet representative, sample of the vectors actually encountered in the data to be encoded. Therefore, to transmit a vector, the most closely matching codebook entry is selected and its address is transmitted. This vector quantization approach has the advantage of providing a reduced bit rate but introduces distortion in the signal due to the mismatch between the actual speech vector and the selected entry in the codebook.

In the construction of the codebook, the short term predictor filter coefficients of a speech frame of duration 10 to 30 milliseconds (ms) are obtained using conventional linear predictor analysis. A tenth-order model is very common. The short term, tenth-order model parameters are updated at intervals of 10 to 30 ms, typically 20 ms. The quantization of these parameters is usually carried out in a domain where the spectral distortion introduced by the quantization process is perceived to be minimal for a given number of bits. One such domain is the line spectral frequency domain due, in part, to the fact that a valid set of line spectral frequencies is necessarily an ordered set of monotonically increasing frequencies. While the complexity of conversion of the short term predictor parameters to line spectral frequencies depends on the degree of resolution required, little loss of performance has been observed using the vector quantization scheme, even with 40 Hz resolution. Generally speaking, the speech mode based vector quantizer of the present invention quantizes and encodes ten line spectral frequencies using either 12 or 22 address bits. However, other numbers of line spectral frequencies could be used if desired and other types of vectors besides LSF vectors could be used in the vector quantization scheme of the present invention.

Figure 1:
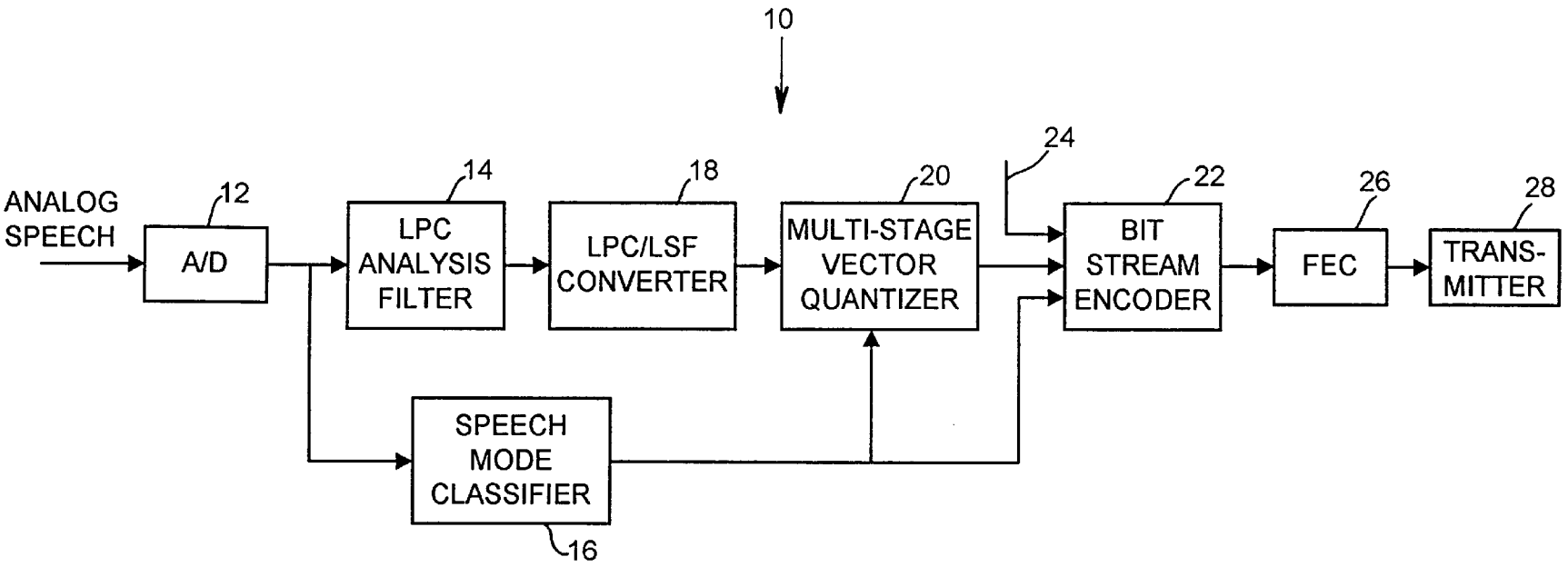
FIG. 1 is a block diagram illustrating a speech encoder using the multi-stage LSF vector quantizer of the present invention.

Referring now to FIG. 1, an encoder 10 (which may be part of a cellular codec) is illustrated as including a speech mode based, multi-stage vector quantizer according to the present invention. Analog speech which may be produced by a microphone or a handset of a communication system (such as a mobile telephone system) is provided to an analog to digital (A/D) converter 12 that converts the analog speech into digital signals comprising speech frames of, for example, 20 ms in length. The 20 ms speech frames are provided to an LPC Linear Predictive Coding) analysis filter 14 as well as to a speech mode classifier 16. The LPC analysis filter 14, which may be any LPC filter manufactured, according to, for example, the IS-641 or IS-127 standard, or any other known LPC analysis filter, determines the linear predictive coding coefficients associated with each 20 ms speech frame in any known or standard manner.

The output of the LPC analysis filter 14, which is a vector comprising the LPC coefficients associated with each incoming speech frame, is provided to an LPC/LSF converter 18 that converts the LPC coefficients to, for example, a tenth-order LSF vector, i.e., an LSF vector having ten components associated therewith. Of course, the LPC/LSF converter 18 may be any standard converter for converting LPC vectors or coefficients into associated LSF vectors and may be, for example, one that follows the IS-127 or the IS-641 standard.

The output of the LPC/LSF converter 18 comprises an LSF vector which may be, for example, a tenth-order vector having ten individual components, each associated with one of the ten line spectral frequencies used to model the speech signal. This signal is delivered to a multi-stage vector quantizer 20 which also receives the output of the speech mode classifier 16. Generally speaking, the speech mode classifier 16 identifies, for each speech frame, whether that frame comprises a voiced speech or an unvoiced speech and, if it is a voiced speech frame, identifies whether that frame is spectrally stationary or spectrally non-stationary. Spectrally stationary voiced speech frames are known as Mode A frames, spectrally non-stationary voiced speech frames are known as Mode B frames and unvoiced speech frames are known as Mode C frames. The speech mode classifier 16 may operate according to any known or desired principles and may, for example, operate as disclosed in Swaminathan et al., U.S. Pat. No. 5,596,676 entitled "Mode-Specific Method and Apparatus for Encoding Signals Containing Speech," which is hereby incorporated by reference herein.

Generally speaking, the multi-stage vector quantizer 20 determines a set of codebook addresses corresponding to the input speech frame depending on the mode of that speech frame as determined by the speech mode classifier 16. The multi-stage vector quantizer 20 may include a two-stage quantizer that quantizes Mode A speech frames using two codebook addresses while the multi-stage vector quantizer 20 may include a four-stage vector quantizer that quantizes Mode B and Mode C speech frames using four codebook addresses. According to this set-up, the multi-stage vector quantizer 20 outputs either two six-bit addresses (12 bits) for Mode A speech frames or four addresses (two six-bit addresses and two five-bit addresses for a total of 22 bits) for Mode B and Mode C speech frames. The addresses produced by the quantizer 20 are delivered to a bit stream encoder 22 along with an identification of the mode of the speech frame as identified by the speech mode classifier 16.

The bit stream encoder 22 encodes a transmission bit stream with either the two six-bit addresses (Mode A) or the two six-bit and the two five-bit addresses (Modes B and C) produced by the multi-stage vector quantizer 20 along with, for example, a one-bit indication of the mode of that speech frame, to indicate the codebook addresses storing the vectors required to reproduce the LSF vector associated with the speech frame. Of course, the bit stream encoder 22 may also encode other information required to be transmitted to a receiver provided on, for example, a line 24. This other information may be any known or desired information necessary for coding and/or decoding speech frames (or other data) as known by those skilled in the art and, as such, will not be discussed further herein.

The bit stream encoder 22 outputs a continuous stream of bits for each frame or data packet to be transmitted to a receiver and provides this bit stream to a forward error correction (FEC) encoder 26 that encodes the bit stream using any standard or known FEC encoding technique. As will be discussed in more detail, the FEC encoder 26 preferably encodes the most significant bits of each of the addresses (i.e., the two six-bit addresses for Mode A speech frames and the two six-bit and two five-bit addresses for Mode B and C speech frames) and encodes the first addresses in each group of two or four addresses with a higher degree of coding to enable a receiver to best reproduce a speech frame in the presence of transmission bit errors. The FEC encoder 26 provides an FEC encoded signal to a transmitter 28 which transmits the FEC encoded signal to a receiver using, for example, cellular telephone technology, satellite technology, or any other desired method of transmitting a signal to a receiver.

Figure 2:
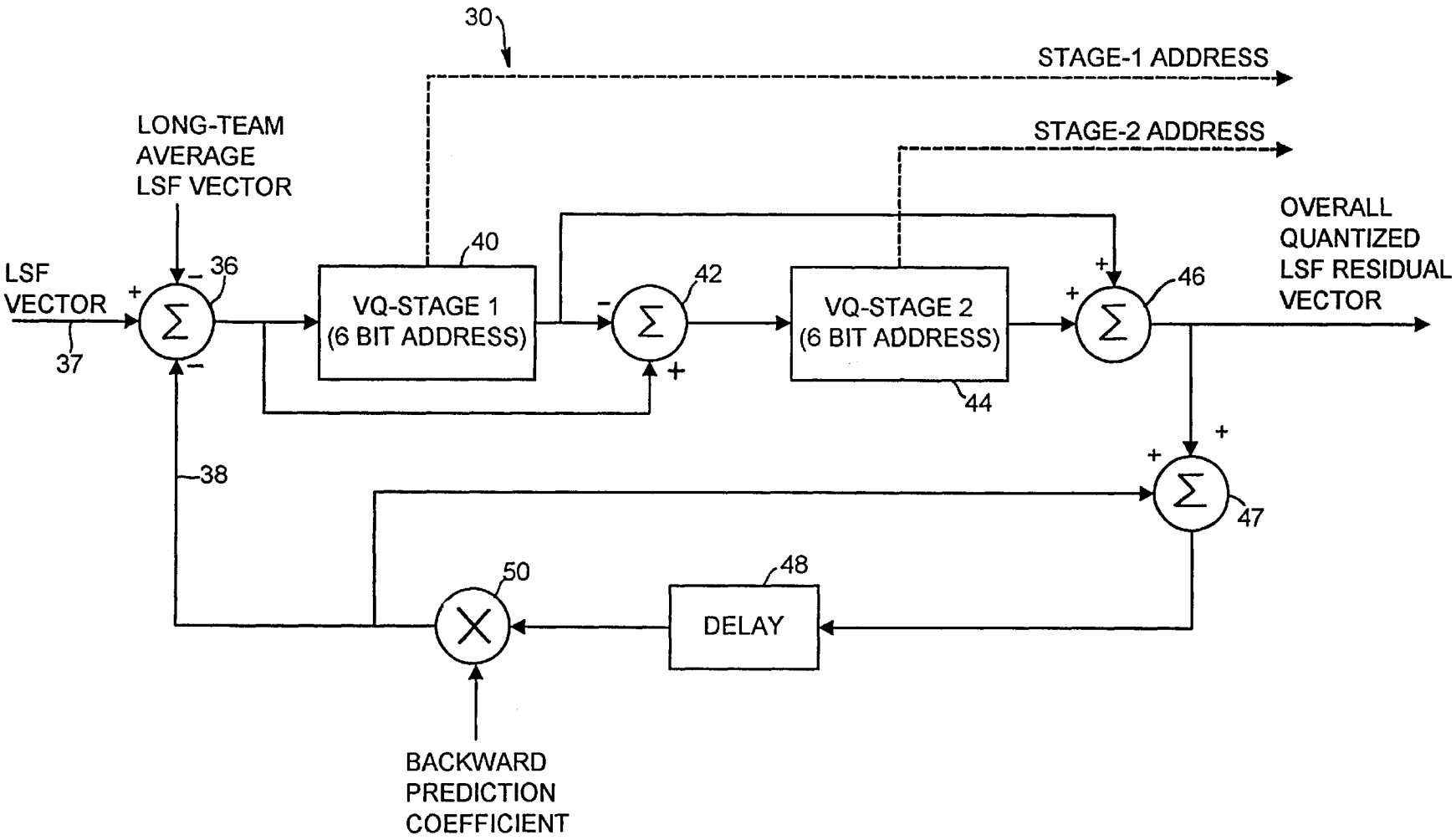
FIG. 2 is a block diagram illustrating a two-stage LSF vector quantizer for encoding Mode A speech frames.
Figure 3:
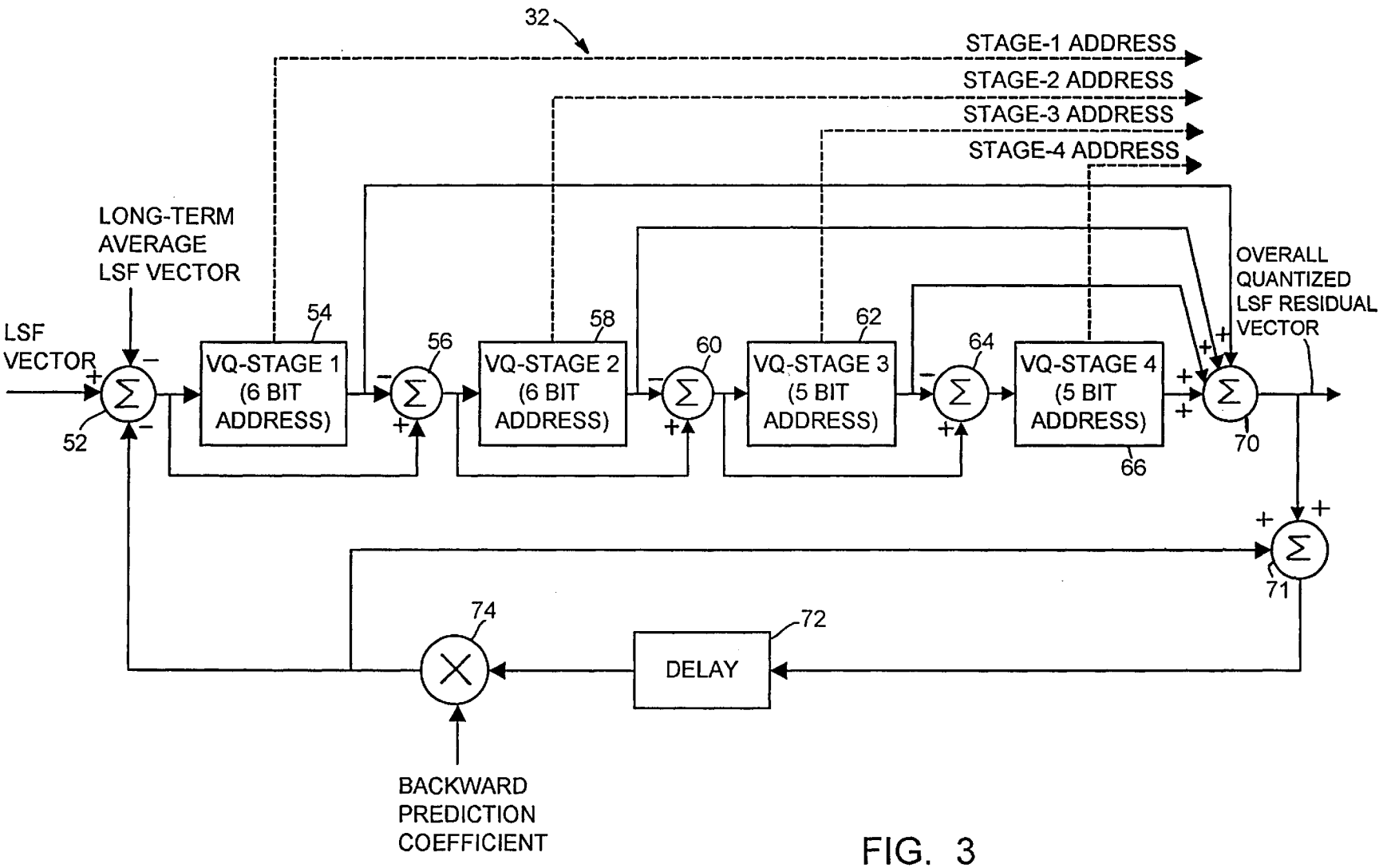
FIG. 3 is a block diagram illustrating a four-stage LSF vector quantizer for encoding Mode B and C speech frames.

Referring now to FIGS. 2 and 3, the components of one embodiment of the multi-stage vector quantizer 20 will be described in more detail. In the illustrated embodiment, the multi-stage vector quantizer 20 includes a two-stage vector quantizer section 30 (illustrated in FIG. 2) that encodes LSF vectors identified as being associated with Mode A speech frames and a four-stage vector quantizer 32 (illustrated in FIG. 3) that encodes LSF vectors identified as being associated with Mode B or Mode C speech frames. Generally speaking, each stage of the vector quantizer sections 30 and 32 includes a codebook having a set of quantized LSF residual vectors stored therein. An LSF residual vector, which may be the difference between an LSF residual vector input to a previous stage and a quantized LSF residual vector output by a codebook of that previous stage, is provided to the input of the codebook of each stage and is compared with the vectors stored in that codebook to determine which stored quantized LSF residual vector most closely matches the input LSF residual vector. The address of the quantized LSF residual vector that most closely matches the input LSF residual vector is delivered to the output of the quantizer 20 as one of the addresses to be transmitted to a receiver and the identified quantized LSF residual vector (stored at the identified address) is subtracted from the input LSF residual vector to produce another LSF residual vector to be supplied to the input of the next stage. The stages are connected in a first order backward predictive arrangement so that a correlation component of the overall quantized LSF residual vector produced by the quantizer sections 30 and 32 for a previous speech frame is removed from the LSF vector for a new speech frame to reduce the correlation between adjacent speech frames which, in turn, reduces the number of address bits necessary to adequately encode an LSF vector for a speech frame. The multi-stage configuration of each of the sections 30 and 32 may be thought of as producing successively finer estimations of a set of quantized LSF residual vectors which, when summed together, produce an overall quantized LSF residual vector that closely approximates the input LSF vector (having the correlation associated with previous speech frames and a DC bias removed therefrom).

Referring now to FIG. 2, the two-stage vector quantizer section 30 for use in quantizing Mode A speech frames (i.e., spectrally stationary voiced speech frames) includes a summer 36 that receives (on a line 37) the LSF vector output by the LPC/LSF converter 18. The summer 36 subtracts a long-term average LSF vector and a backward prediction LSF vector (provided on a line 38) from the LSF vector on the line 37 to produce a first-stage LSF residual vector. Generally speaking, the long-term average LSF vector is obtained by averaging all of the LSF vectors used to train the codebooks of the separate stages of the vector quantizer section 30 and may be thought of as a DC bias associated with the set of training vectors used within the codebooks of the vector quantizer section 30. As will be understood, the first-stage LSF residual vector produced by the summer 36 is an LSF vector having the DC bias (long-term average) and a backward prediction amount (associated with spectral correlation between adjacent speech frames) removed therefrom.

The first-stage LSF residual vector produced by the summer 36 is provided to a first-stage vector quantizer 40 having a codebook that includes 26 quantized LSF residual vectors stored therein. As a result, each of the stored quantized LSF residual vectors may be uniquely identified by a six bit address. The first-stage vector quantizer 40 determines which of the stored quantized LSF residual vectors most closely matches the first-stage LSF residual vector provided at the input thereto and outputs that stored quantized LSF residual vector to a summer 42. The address of the identified quantized LSF residual vector stored in the first-stage codebook is output as the stage-1 address.

The first-stage vector quantizer 40 may determine which of the quantized LSF residual vectors stored in the codebook associated therewith most closely matches the input first-stage LSF residual vector using any desired technique. Preferably, however, a weighted distortion measurement, such as a weighted Euclidean distance measurement similar to the that identified in Paliwal et al., "Efficient Vector Quantization of LPC Parameters at 24 bits/frame," IEEE Transactions on Speech and Audio processing, Vol. 1, No. 1 (January 1993) may be used. Accordingly, the weighted distribution measurement d(e,ê) between the input LSF residual vector (e) and a quantized LSF residual vector (ê) stored within the codebook is given by equation 1 provided below:

$$d(e,\hat{e})\sum_{j=1}^{p} w_j(e_j-\hat{e}_j)^2 \tag{1}$$

wherein:

e=the LSF residual vector input to the vector quantizer stage;

ê=the quantized LSF residual vector stored in the vector quantizer stage under consideration;

p=the number of vector components of the LSF residual vector (e.g., 10);

$e_j$=the value of the jth vector component of the LSF residual vector e;

$\hat{e}_j$=the value of the jth vector component of the quantized LSF residual vector ê within the codebook being evaluated;

$w_j$=the weight assigned to the jth line spectral frequency.

The weight $w_j$ is given by evaluating the LPC power spectrum density at the jth line spectral frequency $1_j$ such that:

$$w_j=[PSD(1_j)]^r \tag{2}$$

wherein:

r=an experimentally determined constant preferably equal to 0.3, as given in Paliwal et al.

The weighted distortion measure $w_j$ basically weighs the LSF residuals based on the amplitude of the power spectrum at the corresponding LSF value.

As noted above, the first-stage quantizer 40 outputs a first-stage quantized LSF residual vector to the summer 42, which is subtracted from the first-stage LSF residual vector to produce a second-stage LSF residual vector which, in turn, is provided to a second-stage vector quantizer 44. The second-stage vector quantizer 44 compares the second-stage LSF residual vector to the quantized LSF residual vectors stored in a codebook thereof to identify which of the stored quantized LSF residual vectors most closely approximates the second-stage LSF residual vector. The address of the identified quantized LSF residual vector is provided to the output of the vector quantizer 20 as a stage-2 address while the identified quantized LSF residual vector is provided to a summer 46 as a second-stage quantized LSF residual vector. Of course, the addresses developed by the vector quantizer stages 40 and 44 are provided to the bit stream encoder 22 (FIG. 1) as the addresses to be transmitted to a receiving unit.

As indicated in FIG. 2, the summer 46 adds the first-stage quantized LSF residual vector and the second-stage quantized LSF residual vector together to produce an overall quantized LSF residual vector that represents the LSF residual vector that will be decoded and used by the receiver to develop a transmitted speech frame. This overall quantized LSF residual vector is fed back though a summer 47 (where it is summed with a value developed from the overall quantized LSF residual vector of the previous speech frame), through a frame delay circuit 48, which delays the output of the summer 47 by one speech frame, e.g., 20 ms, and then to a multiplier 50. The multiplier 50 multiplies the delayed signal by a backward prediction coefficient and outputs a backward prediction LSF vector to the summer 36 which is used to reduce the spectral correlation between adjacent speech frames. Operation of the summer 47, the delay circuit 48, the multiplier 50 and the summer 36 removes or reduces the spectral correlation between the overall quantized LSF residual vectors of adjacent frames, which enables the number of quantized LSF residual vectors stored in the vector quantizer stages 40 and 44 to be reduced which, in turn, enables the use of codebook addresses with reduced number of bits.

The backward prediction coefficient provided to the multiplier 50 may comprise any desired value but, preferably, is a first-order backward prediction coefficient having correlation coefficients represented by a diagonal matrix Â estimated in a minimum mean square error sense from a training set of LSF residual vectors classified as being associated with Mode A speech frames. In particular, the diagonal elements of the matrix Â may be given by:

$$\hat{A}[j][j] = \frac{\sum_{i=1}^{N} d_i[j] \cdot d_{i-1}^T[j]}{\sum_{i=1}^{N} d_{i-1}^2[j]} \quad (3)$$

wherein:

N=the number of frames in the training set of LSF residual vectors;

j=ranges from one to the number of vector components within the LSF residual vector, e.g., 10; and $d_i$=the value of the ith LSF differential vector component (i.e., of the vector produced by the subtraction of the long-term average LSF vector from the LSF vector).

Thus, as will be understood, the overall quantized LSF residual vector from the previous frame (having a correlation component added thereto) is multiplied in the multiplier 50 (using vector multiplication) by the Â matrix, which is a correlation coefficient matrix developed from a training set of Mode A speech frames, to produce a backward prediction LSF vector representing an estimate of the spectral correlation between adjacent speech frames. This backward prediction LSF vector is then subtracted from the input LSF vector for the speech frame at the input of the vector quantizer 20 to eliminate or reduce the correlation between successive speech frames.

Because the vector quantizer section 30 encodes Mode A speech frames, which have spectrally stationary components that are highly correlated across adjacent speech frames, an aggressive backward prediction network can be used to eliminate the correlation and, thereby, significantly reduce the number of vectors required to be stored in the codebooks of the quantizer stages 40 and 44. In fact, as is evident from FIG. 2, it has been found that Mode A speech frames can be adequately quantized using two six-bit addresses (for a total of 12 bits). Furthermore, a coder using this quantizer for Mode A speech frames only needs to store $2\times2^6$ (i.e., 128) quantized LSF residual vectors in codebook memory for quantizing tenth-order LSF vectors associated with Mode A speech frames.

Referring now to FIG. 3, the four-stage vector quantizer section 32 for use in quantizing Mode B and C speech frames (i.e., voiced spectrally non-stationary and unvoiced speech frames) is similar to that of FIG. 2 except that it includes four interconnected stages instead of two. As illustrated in FIG. 3, the vector quantizer section 32 includes a summer 52 that subtracts a long-term average LSF vector and a backward prediction LSF vector from an input LSF vector (identified as being associated with a Mode B or a Mode C speech frame) to produce a first-stage LSF residual vector. Similar to the quantizer section 30, the long-term average LSF vector is an average of all of the vectors used to train the codebooks of the stages used in the quantizer section 32 while the backward prediction LSF vector is developed from the previous encoded speech frame.

The first-stage LSF residual vector is provided to an input of a first-stage quantizer 54 having $2^6$ quantized LSF residual vectors stored in a codebook therein. As with the first-stage quantizer 40 of FIG. 2, the first-stage quantizer 54 compares the first-stage LSF residual vector with each of the stored quantized LSF residual vectors to identify which of the stored quantized LSF residual vectors most closely matches the LSF residual vector using, for example, the Euclidean distance measurement of equation 1. The first-stage quantizer 54 produces the six-bit address of the identified quantized LSF residual vector on a stage-1 address line and delivers the identified, first-stage quantized LSF residual vector stored at that address to a summer 56.

The summer 56 subtracts the first-stage quantized LSF residual vector from the first-stage LSF residual vector to produce a second-stage LSF residual vector which is provided to an input of a second-stage quantizer 58 which, preferably, includes a codebook having $2^6$ quantized LSF residual vectors stored therein addressable with a 6-bit address. The second-stage quantizer 58 compares the second-stage LSF residual vector to the quantized LSF residual vectors stored therein to determine the closest match and delivers the six-bit address of the closest match on a stage-2 address line and delivers the quantized LSF residual vector stored at that address as a second-stage quantized LSF residual vector to a summer 60.

Similarly, the summer 60 subtracts the second-stage quantized LSF residual vector from the second-stage LSF residual vector to produce a third-stage LSF residual vector which is provided to an input of a third-stage quantizer 62 which, preferably, includes a codebook having $2^5$ quantized LSF residual vectors stored therein addressable with a 5-bit address. The third-stage quantizer 62 compares the third-stage LSF residual vector to the quantized LSF residual vectors stored therein to determine the closest match and delivers the five-bit address of the closest match on a stage-3 address line and delivers the quantized LSF residual vector stored at that address as a third-stage quantized LSF residual vector to a summer 64.

As will be evident, the summer 64 subtracts the third-stage quantized LSF residual vector from the third-stage residual vector to produce a fourth-stage LSF residual vector which is provided to an input of a fourth-stage quantizer 66 which, preferably, includes a codebook having $2^5$ quantized LSF residual vectors stored therein addressable with a five-bit address. The fourth-stage quantizer 66 compares the fourth-stage LSF residual vector to the quantized LSF residual vectors stored therein to determine the closest match and delivers the five-bit address of the closest match on a stage-4 address line and delivers the quantized LSF residual vector stored at that address as a fourth-stage quantized LSF residual vector to a summer 70.

The summer 70 sums the first-stage, second-stage, third-stage and fourth-stage quantized LSF residual vectors to produce an overall quantized LSF residual vector that, when a correlation component and the long-term average LSF vector is added thereto, represents the LSF vector decoded by a receiver unit. Of course, some quantization error exists in this vector due to the approximations made in each of the four stages of the quantizer section 32. The overall quantized LSF residual vector is provided to a summer 71, where a correlation component is added thereto, through a delay circuit 72, which delays the output of the summer 71 by one frame time, e.g., 20 ms, and to a multiplier 74, which multiplies the delayed vector by a backward prediction coefficient determined for Mode B and Mode C speech frames. The output of the multiplier 74 is then provided to an inverting input of the summer 52 to be subtracted from the LSF vector associated with the speech frame at the input of the quantizer section 32.

Because Mode B and Mode C speech frames are not highly correlated with one another, the backward prediction coefficient provided to the summer 74 is not as aggressive as that used for Mode A speech frames (as discussed above with respect to FIG. 2). In fact, it has been experimentally determined that a scalar value of about 0.375 or higher may be advantageously used as the backward prediction coefficient provided to the multiplier 74 for Mode B and Mode C speech frames. Of course, if desired, other determined backward prediction coefficients may also be used for Mode B and Mode C speech frames, as well as for other types of speech. Because Mode B and Mode C speech frames are not highly correlated and, therefore, an aggressive backward prediction scheme cannot be used to reduce correlation between adjacent speech frames, the quantizer section 32 for Mode B and Mode C speech frames requires more stages and, therefore, more stored quantized LSF residual vectors than the quantizer section 30 for Mode A speech frames. Thus, as will be understood, the illustrated quantizer section 32 uses two codebooks having six-bit addresses and two codebooks having five-bit addresses to quantize a Mode B or a Mode C speech frame so that the output of the quantizer section 32 comprises six-bit stage-1 and stage-2 addresses along with five-bit stage-3 and stage-4 addresses, all of which are provided to the bit stream encoder 22 for delivery to a receiver.

While the multi-stage quantizer 32 requires 22 address bits to adequately quantize a Mode B or a Mode C speech frame along with a one-bit mode indication for a total of 23 bits, which is only slightly less than the number of bits used in prior art systems, the quantizer 30 requires the use of only 12 address bits along with a one-bit mode indication for a total of 13 bits to quantize Mode A speech frames, which is significantly less than any prior art system. Because Mode A speech frames are estimated to comprise about 30 percent of the total speech frames transmitted in a telecommunications system, the average number of bits necessary to send a speech frame is about 20 bits, which is significantly less than prior art systems. Furthermore, the backward prediction scheme disclosed herein uses less codebook memory because it stores only $2^6$ or $2^5$ vectors for each of six codebooks (for a total of 320 vectors). This feature enables the use of small codebook memories in both the transmitter and receiver.

While the addresses of the codebook vectors are described as being determined in a single pass-through of the two-stage or four-stage backward prediction networks of FIGS. 2 and 3, it is preferable to use an M-L tree search procedure, such as that described in LeBlanc et al., in the two-stage and the four-stage networks of FIGS. 2 and 3 to determine the best set of addresses for quantizing any particular speech frame. In such an M-L search procedure, the M quantized LSF residual vectors stored in a codebook that are closest to the input LSF residual vector are determined at the first stage so that M second-stage LSF residual vectors are computed at the output of the first stage. Each of these M second-stage LSF residual vectors is then used in the second stage to identify M of the closest codebook vectors thereto. After the codebook of the second stage has been searched, the M paths that achieve the overall lowest distortion (including the first and the second stages) are selected to produce M third-stage LSF residual vectors. This procedure is repeated for each of the rest of the stages so that there are M identified paths at the output of the last stage. The best out of the M identified paths is chosen by minimizing the weighted distortion measurement between the input LSF residual vector and the overall quantized LSF residual vector and the addresses of the codebook vectors in the selected one of the M paths are delivered to the output of the quantizer. It has been discovered that selecting an M equal to eight provides good results in a telecommunications system. Of course, if desired, other methods of searching the codebooks of each of the stages of the quantizer sections 30 and 32 may be used instead.

Figure 4:
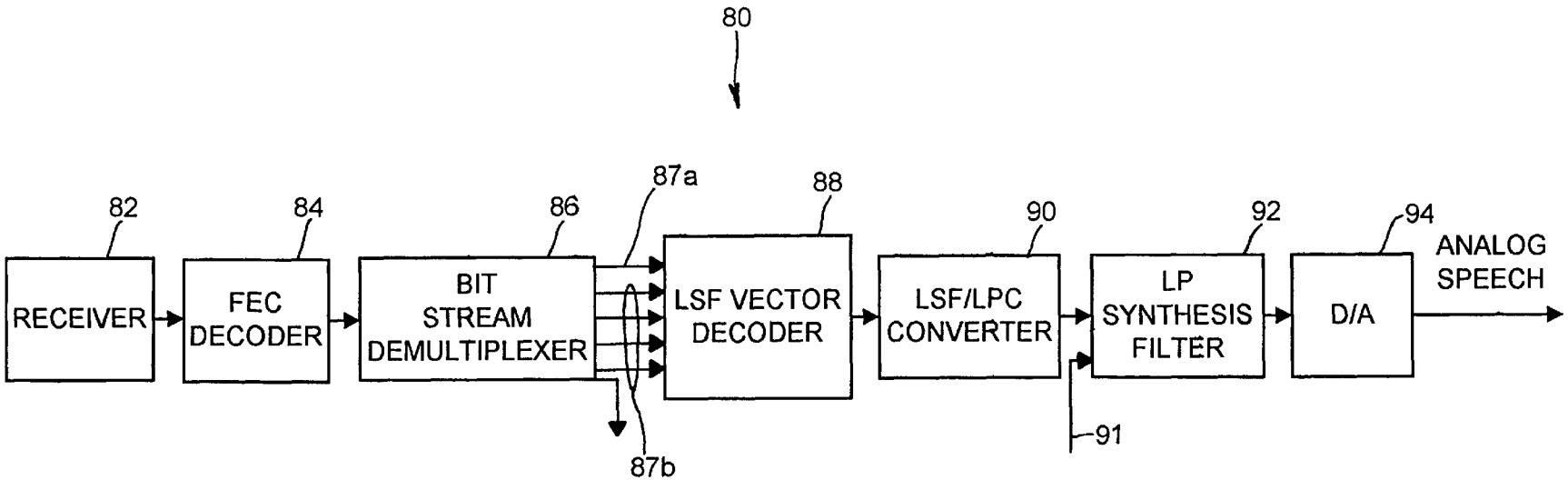
FIG. 4 is a block diagram illustrating a speech receiver/decoder including an LSF vector decoder according to the present invention.

Referring now to FIG. 4, a decoder 80, which may be part of a receiver codec, is illustrated in block diagram form. The decoder 80 includes a receiver circuit 82 that receives the encoded communication signal transmitted by the transmitter 28 of FIG. 1 including all of the information necessary for decoding and reproducing a set of speech frames. An FEC decoder 84 removes the error encoding and provides an output bit stream to a bit stream demultiplexer 86 which, decodes the one-bit signal indicative of the mode of a speech frame and places this signal on a line 87*a*. The demultiplexer 86 also decodes the two or four codebook addresses transmitted for each of the speech frames (each of which is either five or six bits in length) and places these codebook addresses on lines 87*b*. If the received speech frame is a Mode A frame, two six-bit codebook addresses are demultiplexed while, if the speech frame is a Mode B or a Mode C speech frame, four codebook addresses (two six-bit and two five-bit) are demultiplexed. The demultiplexer 86 also decodes other bits within the transmitted signal and provides these bits to appropriate decoding circuitry (not shown) in the receiver.

An LSF vector decoder uses the mode indication on the line 87*a* and the two or four addresses on the lines 87*b* to recover the quantized LSF residual vectors stored at the indicated address and uses these vectors to create the overall quantized LSF residual vector for each speech frame and, from that, the quantized LSF vector for each speech frame. The quantized LSF vector is then delivered to an LSF/LPC converter 90 which operates in any known manner to convert the LSF vector into a set of LPC coefficients. An LP synthesis filter 92 produces a digital speech stream from the set of LPC components for each speech frame (and from other decoded information provided on a line 91) in any known manner and delivers such a digital speech frame to a digital to analog (D/A) converter 94 which produces analog speech that may be provided to a speaker or a handset. Of course, the LSFILPC converter 90 and the LP synthesis filter 92 are well known in the art and may be, for example, manufactured according to the IS-641 or the IS-127 standard or may be any other devices that convert LPC coefficients to digital speech.

Figure 5:
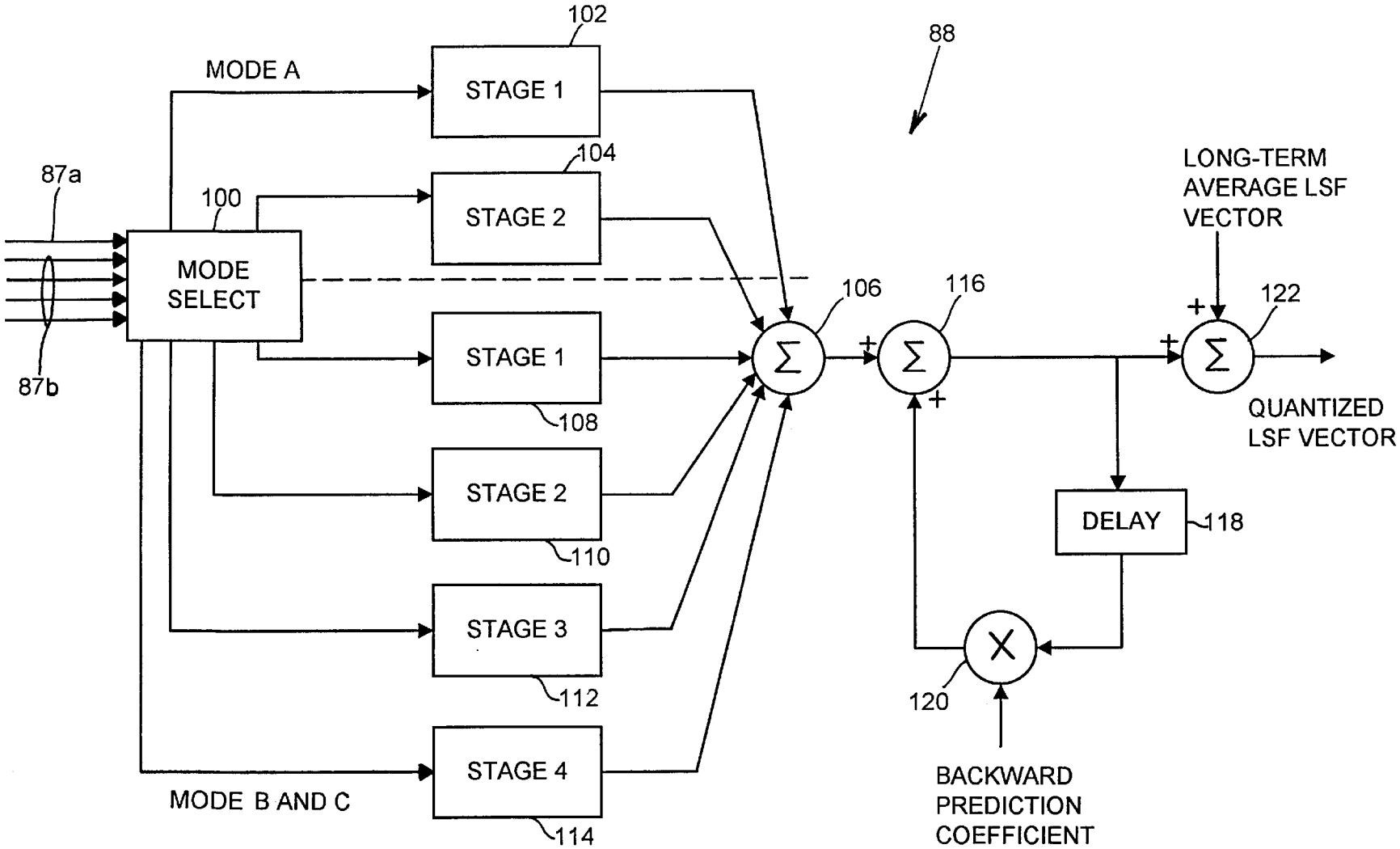
FIG. 5 is a block diagram of the vector decoder of the receiver/decoder of FIG. 4.

As illustrated in FIG. 5, the LSF vector decoder 88 includes a mode select unit 100 that receives the mode indication signal on the line 87*a* and the address signals on the lines 87*b*. The mode select unit 100 determines which one of the modes, i.e., Modes A, B or C, with which the speech frame is associated. If the incoming quantized speech frame is a Mode A speech frame, the mode select unit 100 provides the stage-1 and stage-2 addresses (on the lines 87*b*) to stage 1 and stage 2 codebooks 102 and 104. The codebooks 102 and 104 store the same quantized LSF residual vectors stored in the codebooks of the first-stage vector quantizer 40 and the second-stage vector quantizer 44 of FIG. 2. The stage 1 and stage 2 codebooks output the vectors stored at the indicated addresses and these vectors are summed together in a summer 106 to produce the overall quantized LSF residual vector.

Alternatively, if the mode selection unit 100 determines that either a Mode B or a Mode C speech frame is present at the input of the decoder 88 based on the mode indication on the line 87*a*, the mode select unit 100 passes the four addresses on the lines 87*b* directly to the stage 1, stage 2, stage 3 and stage 4 codebooks 108, 110, 112 and 114, respectively. As will be understood, the stage 1 through stage 4 codebooks 108–114 include the same quantized LSF residual vectors as those stored in the codebooks of the vector quantizers 54, 58, 62 and 66 of FIG. 3. The stage 1 through stage 4 codebooks output the vectors stored at the indicated addresses and these vectors are summed together in the summer 106 to produce the overall quantized LSF residual vector for the Mode B or Mode C speech frame. It is understood that the outputs of the codebooks 102 and 104 are zero for Mode B or C speech frames while the outputs of the codebooks 108 through 114 are zero for Mode A speech frames.

The overall quantized LSF residual vector produced by the summer 106 is provided to a summer 116 which adds a correlation component to the overall quantized LSF residual vector to produce a quantized LSF differential vector. The quantized LSF differential vector is then provided to a delay line 118 which delays this vector by one frame time (e.g., 20 ms) and then provides this delayed vector to a multiplier 120. The multiplier 120 multiplies the delayed quantized LSF differential vector by a backward prediction coefficient which, preferably, is the same backward prediction coefficient used within the quantizer sections 30 and 32. The output of the multiplier 120 is then provided to the summer 116 which sums this signal with the overall quantized LSF residual vector as noted above. A summer 122 sums the quantized LSF differential vector with the long-term average LSF vector (which is the same as that used in the quantizer sections 30 and 32) to produce the quantized LSF vector for that speech frame. The operation of the delay circuit 118, the multiplier 120 and the summers 116 and 122 returns the DC bias and the correlation component to the overall quantized LSF residual vector, both of which were removed by the encoder system using the backward prediction networks of the quantizer sections 30 and 32. Thus, when a Mode A speech frame is present, the backward prediction coefficient is the matrix Â and the long-term average LSF vector is the same as that provided to the summer 36 of FIG. 2 while, when a Mode B or a Mode C speech frame is present, the backward prediction coefficient is about 0.375 or whatever other scalar multiplier (or other signal) was used in the quantizer section 32 and the long-term average LSF vector is the same as that provided to the summer 52 of FIG. 3.

Table 1 below compares the operation of the Multi-Mode Multi-stage Vector Quantization (MM-MSVQ) scheme described herein versus the operation of the known 22-bit split vector quantizer (IS-127) referred to above. The speech data (speech frames) used for these comparisons were different than the speech data used to train the codebooks of the MM-MSVQ technique. For this comparison, the speech data was passed through the front-end mode classification scheme of the present invention and the quantized LSF vectors were reconstructed using the MM-MSVQ codebooks. The quantized and original LSF vectors were compared using averages and outlier percentages of the well known log spectral distortion (LSD) metric.

It is known that, for efficient quantization, an average log spectral distortion of 1 dB across all test vectors is very important. In Table 1, the LSD statistics are presented for the 12/22 bit MM-MSVQ codebooks and are compared to the performance of a 22 bit Split VQ codebook which has been used in the half rate operation of the IS-127 coder. In Table 1, "LSD" refers to the log spectral distortion over the entire frequency range of 0–4 Khz for 8 KHz sampled speech, and "LSD1" refers to the frequency band of 0–3 KHz, which contains more of the high formant energies.

As clearly illustrated in Table 1, the 22 bit split vector quantizer (VQ) produces an average log spectral distortion of 0.56 dB greater than the 1 dB criterion, whereas, for the 12/22 bit MM-MSVQ codebooks, the average log spectral distortion is maintained at 1.11 dB. Moreover, outliers in the range of 2–4 dB are at 9.99% for the 22 bit split VQ whereas, for the 12/22 bit MM-MSVQ, the same outliers make up only around 3.18% of all test vectors. Similar results can be seen for the LSD1 case.

TABLE 1

| | 12/22 bit MM-MSVQ | 22 bit Split VQ (IS-127) |
|---|---|---|
| Average LSD | 1.11 | 1.56 |
| % fr. >2 dB | 3.18 | 9.99 |
| % fr. >4 dB | 0.02 | 0.02 |
| Average LSD1 | 1.10 | 1.60 |
| % fr. >2 dB | 2.97 | 13.99 |
| % fr. >4 dB | 0.035 | 0.05 |

An added advantage of the present invention is that robust error correcting techniques can be advantageously used with the speech mode based, multi-stage vector quantizer described herein. In fact, it has been noted that bit errors within the addresses of the codebooks for earlier stages are generally more detrimental to accurate decoding of the quantized LSF vector than bit errors within the addresses of the codebooks for the later stages. Likewise, bit errors within the earlier bits of the address for a codebook of a particular stage are more detrimental to accurate decoding of the quantized LSF vector than bit errors within the later bits of the address for the codebook of that same stage.

Table 2 below illustrates the performance of Mode A speech frames in the presence of transmission bits errors in the 12-bit, two-stage VQ of the present invention using log spectral distortion and outlier percentages for each of the different bits. Table 3 illustrates the performance of all Mode B and C speech frames in the presence of transmission bit errors in the 22-bit, four-stage VQ described above.

TABLE 2

| | Av. LSD | % fr. >2 dB | % fr. >4 dB | Av. LSD1 | % fr. >2 dB | % fr. >4 dB |
|---|---|---|---|---|---|---|
| No. Errors | 1.27 | 4.4 | 0.0 | 1.23 | 3.84 | 0.0 |
| I - B1 MSB | 1.62 | 20.9 | 2.66 | 1.63 | 20.9 | 3.7 |
| I - B2 | 1.67 | 21.3 | 3.9 | 1.66 | 21.0 | 4.7 |
| I - B3 | 1.60 | 19.8 | 2.15 | 1.60 | 19.7 | 3.1 |
| I - B4 | 1.57 | 19.4 | 1.3 | 1.55 | 19.4 | 1.9 |
| I - B5 | 1.48 | 16.1 | 0.2 | 1.46 | 16.0 | 0.3 |
| I - B6 LSB | 1.42 | 11.7 | 0.01 | 1.38 | 11.2 | 0.04 |
| II - B1 MSB | 1.47 | 15.2 | 0.08 | 1.44 | 14.7 | 0.2 |
| II - B2 | 1.46 | 14.5 | 0.07 | 1.43 | 14.2 | 0.16 |
| II - B3 | 1.47 | 15.5 | 0.09 | 1.45 | 15.4 | 0.19 |
| II - B4 | 1.46 | 14.4 | 0.05 | 1.43 | 14.2 | 0.16 |
| II - B5 | 1.44 | 13.5 | 0.05 | 1.41 | 12.9 | 0.11 |
| II - B6 LSB | 1.43 | 12.1 | 0.07 | 1.39 | 11.4 | 0.08 |

TABLE 3

| | Av. LSD | % fr. >2 dB | % fr. >4 dB | Av. LSD1 | % fr. >2 dB | % fr. >4 dB |
|---|---|---|---|---|---|---|
| No Errors | 1.16 | 3.6 | .03 | 1.15 | 3.6 | .03 |
| I - B1 MSB | 1.91 | 19.9 | 9.4 | 1.93 | 19.8 | 9.4 |
| I - B2 | 1.93 | 20.5 | 10.0 | 1.92 | 20.2 | 9.6 |
| I - B3 | 1.69 | 17.9 | 6.8 | 1.67 | 17.7 | 6.6 |
| I - B4 | 1.52 | 15.6 | 4.4 | 1.53 | 15.8 | 4.8 |
| I - B5 | 1.53 | 16.0 | 4.85 | 1.53 | 16.0 | 4.9 |
| I - B6 LSB | 1.41 | 13.9 | 1.6 | 1.40 | 13.9 | 1.8 |
| II - B1 | 1.51 | 15.6 | 4.7 | 1.50 | 15.7 | 4.9 |

TABLE 3-continued

| | Av. LSD | % fr. >2 dB | % fr. >4 dB | Av. LSD1 | % fr. >2 dB | % fr. >4 dB |
|---|---|---|---|---|---|---|
| MSB | | | | | | |
| II - B2 | 1.47 | 14.9 | 3.5 | 1.47 | 15.0 | 3.7 |
| II - B3 | 1.48 | 15.1 | 3.8 | 1.47 | 15.1 | 3.7 |
| II - B4 | 1.44 | 14.3 | 2.4 | 1.44 | 14.4 | 2.8 |
| II - B5 | 1.47 | 14.9 | 3.8 | 1.46 | 14.8 | 3.5 |
| II - B6 | 1.38 | 13.3 | 1.06 | 1.38 | 13.4 | 1.37 |
| LSB | | | | | | |
| III - B1 | 1.30 | 10.7 | 0.12 | 1.30 | 10.8 | 0.17 |
| MSB | | | | | | |
| III - B2 | 1.29 | 10.3 | 0.08 | 1.28 | 10.3 | 0.10 |
| III - B3 | 1.31 | 11.2 | 0.12 | 1.30 | 10.9 | 0.21 |
| III - B4 | 1.30 | 10.7 | 0.10 | 1.29 | 10.6 | 0.16 |
| III - B5 | 1.29 | 10.4 | 0.09 | 1.28 | 10.1 | 0.12 |
| LSB | | | | | | |
| IV - B1 | 1.25 | 7.27 | 0.05 | 1.24 | 7.03 | 0.05 |
| MSB | | | | | | |
| IV - B2 | 1.25 | 6.96 | 0.06 | 1.23 | 6.7 | 0.06 |
| IV - B3 | 1.25 | 6.9 | 0.05 | 1.23 | 6.43 | 0.06 |
| IV - B4 | 1.24 | 6.75 | 0.04 | 1.23 | 6.47 | 0.05 |
| IV - B5 | 1.22 | 5.6 | 0.04 | 1.21 | 5.3 | 0.04 |
| LSB | | | | | | |

As will be noted from Tables 2 and 3, the initial stages are more sensitive to transmission bits errors, i.e., the spectral distortion performance degrades more rapidly when the bit errors hit the first stage of the two-stage, 12-bit VQ and the first two stages of the four-stage, 22-bit VQ. Likewise, the most significant bits in each address are more sensitive to bit errors than the least significant bits. Thus, in systems using FEC schemes that cannot protect or recover all of the transmitted bits in the presence of a transmission error, it is desirable to provide the highest bit recovery protection to the addresses of the codebooks associated with the earlier stages and/or to the most significant bits within each address. As a result, using the encoding scheme described herein, FEC techniques can focus on correcting the more sensitive bits (higher stage addresses and the most significant bits of each address) and leaving the less sensitive bits unprotected.

The codebooks of the multi-stage vector quantizers 30 and 32 may be trained in any standard manner including, for example, the manner described in LeBlanc et al. identified above. Generally speaking, the iterative sequential training technique includes two steps. The first step designs an initial set of multi-stage codebooks in a sequential manner such that the codebook at each stage is designed using a training set consisting of quantization error vectors from the previous stage and the codebook at the first stage uses a training set of LSF residual vectors. The codebooks at each stage may be trained using the well known generalized Lloyd algorithm which involves iteratively partitioning the training set into decision regions given a set of centroids or codebook vectors and then re-optimizing the centroids to minimize the average weighted distortion over the particular decision regions. In this first step of the multi-stage vector quantizer design, it is assumed that, at each stage, all the following stages consist of null vectors.

The second step of the iterative sequential training technique involves iterative re-optimization of each stage in order to minimize the weighted distortion over all the stages. Because an initial set of multi-stage codebooks are known, each stage is optimized given the other stages. In other words, the training set for each stage during this second step is the quantization error between the input LSF residual vector and a reconstruction vector consisting of minimum distortion codebook vectors from all stages except the one being re-optimized. This re-optimization process is performed iteratively until a predefined convergence criterion is met. Such an iterative sequential design technique ensures that the overall weighted distortion for multi-stage vector quantizer is minimized rather than minimizing the weighted distortion at each stage.

While the mode-based vector quantizer of the present invention has been described for use in conjunction with a speech communication system, the mode-based vector quantizer can be used in other speech systems having different types of speech data therein. Likewise, although the mode-based vector quantizer of the present invention has been described as being used in a system that classifies speech into the commonly known Mode A, Mode B and Mode C speech frames, the vector quantizer could also be used in systems that classify speech or other data frames into other types of classes.

Thus, while the present invention has been described with reference to specific examples, which are intended to be illustrative only and not to be limiting of the invention, it will be apparent to those of ordinary skill in the art that changes, additions and/or deletions may be made to the disclosed embodiments without departing from the spirit and scope of the invention.

What is claimed is:

1. An encoder for use in encoding a signal for transmission in a communication system, comprising:

a mode classifier that classifies the signal as being associated with one of a plurality of classes;

a converter that converts the signal into a first vector; and a vector quantizer having a first multi-stage section that quantizes the vector according to a first quantization scheme when the signal is classified as being associated with a first one of the classes and a second multi-stage section that quantizes the vector according to a second quantization scheme when the signal is classified as being associated with a second one of the classes, the stages of the first multi-stage section being arranged in a first backward predictive network to reduce correlation between adjacent frames of the signal when the signal is classified as being associated with the first one of the classes, and the stages of the second multi-stage section being arranged in a second backward predictive network to reduce correlation between adjacent frames of the signal when the signal is classified as being associated with the second one of the classes.

2. The encoder of claim 1, wherein the signal is a speech signal and wherein the mode classifier classifies the signal as being associated with one of a spectrally stationary class and a spectrally non-stationary class.

3. The encoder of claim 1, wherein the signal is a speech signal and wherein the mode classifier classifies the signal as being associated with one of a voiced spectrally stationary class, a voiced spectrally non-stationary class and an unvoiced class.

4. The encoder of claim 1, wherein the converter comprises a line spectral frequency (LSF) converter that converts the signal into an LSF vector.

5. The encoder of claim 1, wherein the converter includes a linear predictive coding device that produces a set of linear predictive coding coefficients from the signal and a line spectral frequency (LSF) converter that converts the linear predictive coding coefficients into an LSF vector.

6. The encoder of claim 1, wherein the first vector quantizer section comprises multiple stages connected together in series and wherein each of stages of the first vector quantizer section includes a codebook that stores a set of vectors having the same number of components as the first vector and wherein the second vector quantizer section comprises multiple stages connected together in series and wherein each of the stages of the second vector quantizer section includes a codebook that stores a set of vectors having the same number of vector components as the first vector.

7. The encoder of claim 1, wherein the first vector quantizer section includes two stages and wherein the second vector quantizer section includes four stages.

8. The encoder of claim 7, wherein each of the two stages of the first vector quantizer section is addressable with a six-bit or less address and wherein each of four stages of the second vector quantizer section is addressable with a six-bit or less address.

9. The encoder of claim 7, wherein the first vector quantizer section produces a 12-bit or less encoding signal and wherein the second vector quantizer section produces a 22-bit or less encoding signal.

10. The encoder of claim 1, wherein the first vector quantizer section comprises multiple stages each having an addressable codebook that stores a set of vectors therein, wherein the second vector quantizer section comprises multiple stages each having an addressable codebook that stores a set of vectors therein, wherein each of the stages of the first and second vector quantizer sections produces an address for each of the codebooks therein and wherein the encoder includes a transmission coder that encodes the addresses from one of the first and second vector quantizer sections along with an indication of the class of the signal to produce a transmission signal for transmission over a communication channel.

11. The encoder of claim 10, further including a forward error coder that encodes the transmission signal with a forward error code.

12. The encoder of claim 11, wherein the forward error code is applied to the transmission signal to encode the addresses associated with a first stage of the one of the first and second vector quantizer sections with a first degree of protection, and to encode the addresses associated with a second stage of the one of the first and second vector quantizer sections with a second degree of protection, the first degree of protection being higher than the second degree of protection.

13. A line spectral frequency (LSF) vector quantizer for use in encoding an LSF vector in a digital communication system, comprising:

a mode classifier that classifies the LSF vector as being associated with one of a plurality of modes;

a first multi-stage LSF vector quantizer section having multiple stages that quantize the LSF vector when the LSF vector is associated with a first one of the plurality of modes, the multiple stages of the first multi-stage section being arranged in a backward predictive network to reduce correlation between adjacent frames of a signal associated with the LSF vector when the LSF vector is associated with the first one of the plurality of modes; and a second LSF vector quantizer section having multiple stages that quantize the LSF vector when the LSF vector is associated with a second one of the plurality of modes, the multiple stages of the second multi-stage section being arranged in a backward predictive network to reduce correlation between adjacent frames of the signal associated with the LSF vector when the LSF vector is associated with the second one of the plurality of modes.

14. The LSF vector quantizer of claim 13, wherein the first multi-stage LSF vector quantizer section includes two stages and wherein the second multi-stage LSF vector quantizer section includes four stages, and wherein each of the stages of the first and second vector LSF quantizer sections includes a codebook that stores a set of LSF vectors therein.

15. The LSF vector quantizer of claim 13, wherein the LSF vector has a frame time associated therewith, wherein the first multi-stage LSF vector quantizer section includes a summer that produces an output LSF vector, a delay circuit that delays the output LSF vector by one frame time and a multiplier that multiplies a delayed output LSF vector of a previous frame time by a first backward prediction coefficient.

16. The LSF vector quantizer of claim 15, wherein the first backward prediction coefficient comprises a correlation matrix.

17. The LSF vector quantizer of claim 15, wherein the second multi-stage LSF vector quantizer section includes a summer that produces another output LSF vector, a further delay circuit that delays the another output LSF vector by one frame time and a further multiplier that multiplies a delayed output LSF vector of a previous frame time by a second backward prediction coefficient.

18. The LSF vector quantizer of claim 17, wherein the second backward prediction coefficient is a scalar equal to approximately 0.375 or greater.

19. A method of encoding a speech signal, comprising the steps of:

dividing the speech signal into a series of speech frames;

converting each of the speech frames into a vector;

identifying a mode associated with each of the speech frames as a first mode or a second mode;

encoding the vectors for the speech frames associated with the first mode using a first multi-stage LSF vector encoder including a first backward predictive network to reduce correlation between adjacent speech frames of the speech signal; and, encoding the vectors for the speech frames associated with the second mode using a second multi-stage LSF vector encoder including a second backward predictive network to reduce correlation between adjacent speech frames of the speech signal.

20. The method of claim 19, wherein the step of converting includes the further step of converting each of the speech frames into a line spectral frequency (LSF) vector.

21. The method of claim 20, wherein the step of identifying includes the further step of identifying whether each of the speech frames is a spectrally stationary speech frame or a spectrally non-stationary speech frame.

22. The method of claim 21, wherein the speech frames associated with the first mode comprise spectrally stationary speech frames.

23. The method of claim 22, wherein the step of encoding spectrally stationary speech frames includes the step of multiplying an LSF vector associated with a previous speech frame by a correlation matrix.

24. The method of claim 22, wherein the speech frames associated with the second mode comprise spectrally non-stationary speech frames.

25. The method of claim 21, further including the step of producing a codebook address for each of the stages of one of the first and the second multi-stage LSF vector encoders for a speech frame and transmitting a transmission signal including the addresses produced by the one of the first and the second multi-stage LSF vector encoders along with an indication of the mode for the speech frame.

26. The method of claim 25, further including the step of using a two-stage, backward predictive LSF vector encoder for spectrally stationary speech frames and using a four-stage, backward predictive LSF vector encoder for spectrally non-stationary speech frames.

27. The method of claim 25, further including a step of forward error encoding the transmission signal with a forward error code that is applied to the transmission signal to encode the addresses associated with a first stage of the one of the first and second vector quantizer sections without encoding the addresses associated with a latter stage of the one of the first and second vector quantizer sections.

28. The encoder of claim 12, wherein the second degree of protection comprises no encoding.

29. For use with a receiver, a decoder for decoding a speech frame received by the receiver comprising:

a demultiplexer for separating a received signal into a mode signal indicative of a mode of the speech frame to be decoded and a plurality of codebook addresses associated with the speech frame; and a vector decoder including a first set of codebooks for decoding codebook addresses associated with speech frames classified in a first mode, a second set of codebooks for decoding codebook addresses associated with speech frames classified in a second mode, a mode select unit responsive to the mode signal to route the codebook addresses to one of the first and second sets of codebooks depending on the mode of the speech frame, a summer for developing an overall quantized vector from one of the first and second sets of codebooks, and a correlation component network for adding a correlation component to the overall quantized vector to create a quantized differential vector.

30. The decoder of claim 29, wherein the vector decoder is an LSF vector decoder.

31. The decoder of claim 30, wherein the vector decoder further comprises a second summer for summing a long term average LSF vector with the quantized differential vector to create a quantized LSF vector; and, further comprising an LSF/LPC converter for converting the quantized LSF vector developed by the vector decoder into LPC coefficients.

32. The decoder of claim 31, further comprising an LP synthesis filter for producing a speech stream from the set of LPC coefficients.

33. The decoder of claim 29, further comprising an FEC decoder.

34. The decoder of claim 29, wherein the first set of codebooks comprises two codebooks and the second set of codebooks comprises four codebooks.

35. The decoder of claim 29, wherein the correlation component network comprises a delay circuit, a multiplier, and a summer.

36. The decoder of claim 35, wherein the multiplier multiplies a delayed quantized differential vector with a backward predictive coefficient.

37. The decoder of claim 36, wherein the delayed quantized differential vector is delayed by one time frame.

38. The decoder of claim 36, wherein the backward predictive coefficient is substantially the same as a backward predictive coefficient employed by an encoder used to develop the received signal.

39. The decoder of claim 36, wherein the backward predictive coefficient comprises a matrix for speech frames classified in the first mode, and the backward predictive coefficient comprises a scalar for speech frames classified in the second mode.

* * * * *